US006557513B1

(12) United States Patent
Hill et al.

(10) Patent No.: US 6,557,513 B1
(45) Date of Patent: May 6, 2003

(54) CYLINDER LINER WITH REDUCED WALL THICKNESS ON PISTON PIN AXIS

(75) Inventors: Stephen H. Hill, Muskegon, MI (US); Mark L. Davis, Southgate, MI (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/967,332

(22) Filed: Sep. 28, 2001

(51) Int. Cl.[7] ..... F02F 1/18
(52) U.S. Cl. ..... 123/193.2; 123/193.1
(58) Field of Search ..... 123/193.1, 193.2, 123/193.3–193.6

(56) References Cited

U.S. PATENT DOCUMENTS

| | | | | |
|---|---|---|---|---|
| 2,974,541 A | * | 3/1961 | Dolza | 123/193.1 |
| 3,315,573 A | | 4/1967 | Castel | |
| 3,568,573 A | | 3/1971 | Bailey et al. | |
| 4,399,783 A | | 8/1983 | Hauser | |
| 4,562,799 A | | 1/1986 | Woods et al. | |
| 4,582,028 A | | 4/1986 | Wagner et al. | |
| 4,616,603 A | | 10/1986 | Kubis et al. | |
| 4,796,572 A | | 1/1989 | Heydrich | |
| 5,768,780 A | | 6/1998 | Hobson et al. | |
| 5,927,243 A | * | 7/1999 | Cikanek, Jr. et al. | 123/193.2 |
| 6,123,052 A | * | 9/2000 | Jahn | 123/193.2 |
| 6,182,629 B1 | * | 2/2001 | Gobbels et al. | 123/193.2 |

FOREIGN PATENT DOCUMENTS

| | | | | |
|---|---|---|---|---|
| JP | 406117325 | * | 4/1994 | 123/193.2 |

* cited by examiner

*Primary Examiner*—Paul J. Hirsch
(74) *Attorney, Agent, or Firm*—Rader, Fishman & Grauer PLLC

(57) ABSTRACT

A cylinder liner has reduced wall thickness in a piston pin plane of the liner. A conventional wall thickness of the cylinder liner is maintained in piston thrust plane regions of the liner, where side-to-side motions of a piston reciprocating within the liner tend to produce deflections of the liner, and of a head gasket which bears against the liner. The piston pin plane of the liner is normally orthogonal to the piston thrust plane. The reduced wall thickness affects only external dimensions of the liner; the interior bore of the liner remains fully cylindrical. The exterior of the liner is slightly elliptical, having its minor axis aligned with the plane of the piston pin. The reduced exterior dimension permits an engine designer to reduce engine length due to shortened bore spacing requirements along the piston pin plane, and or to enlarge the space for coolant flow between individual liners.

8 Claims, 3 Drawing Sheets

CYLINDER LINER WITH REDUCED WALL THICKNESS ON PISTON PIN AXIS

BACKGROUND OF THE INVENTION

1. Field of Invention

This invention relates generally to improvements in the manufacture of internal combustion engines of the type that include cylinder liners. More particularly, the invention relates to improvements in design of cylinder liners to provide larger coolant circulation passages between adjacent engine cylinder bores, and/or to reduce longitudinal dimensions of engines.

2. Description of the Prior Art

Cylinder liners are generally employed to extend engine bore life, and to provide compatible wear surfaces for the pistons and rings designed to move reciprocally within engine bores. Liners have traditionally been used in diesel engines. However, with the advent of aluminum block automotive gasoline engines, liners have recently also become commonly used in non-diesel applications.

In addition to accommodating the sealing of an engine head to an engine block, and the prevention of combustion gases from leaking into non-combustion parts of the engine, such liners must be designed to handle side loads imposed by reciprocally movable pistons, which tend to impart a slapping side-to-side motion to the liner walls. Such motion is oriented along a so-called thrust axis of the cylinder liner, and translates into side loads or forces that must be fully accommodated by the liner walls.

The typical piston is connected via a piston pin to a connecting rod. The connecting rod is connected to a crankshaft, as will be appreciated by those skilled in the art. Normally, the piston pin axis is in a plane oriented orthogonally, or at right angles, to the thrust axis plane of the piston. As such, the portion of the cylinder liner oriented along the piston pin bore axis is subject to loads less severe than those that occur along the thrust axis.

Consequently, the traditional wall thicknesses of the liners, normally designed uniformly about the circumference of the liner to accommodate the highest anticipated load, plus traditional safety factors, may be reduced along the piston pin axis portion of the liner to the extent that less of the piston thrust loads are transmitted to the liner walls in the piston pin axis region. Reduction of liner wall thickness in these areas which lie immediately between adjacent cylinder bores, would enable enhanced spacing for coolant flows between respective bores, and/or would accommodate engine designs permitting closer bores, hence smaller engine dimensions along the piston pin plane of the engine.

SUMMARY OF THE INVENTION

The present invention is an improved cylinder liner having a reduced wall thickness in a region of the liner inclusive of the piston pin plane. A traditional wall thickness of the liner is maintained in the piston thrust plane regions for appropriate resistance to high mechanical forces imposed on the liner by the ordinary side-to-side motions of a piston moving reciprocally within the liner. Such forces imparted on the liner walls by the piston tend to produce linear deflections of the liner bore, as well as of the head gasket that bears against the liner.

The reduced wall thickness of the liner affects only its external dimensions in a region along a plane passing through the piston pin axis of the liner. Thus, the bore of the liner remains fully cylindrical while the exterior of the liner is slightly elliptical. The liner has a major axis in alignment with the piston thrust plane, and a minor axis in alignment with the piston pin plane. The reduced dimension along a plane passing through the minor axis permit reduction in engine length due to shortened bore spacing requirements along the piston pin plane, and or can provide additional room for coolant to flow between adjacent cylinder liners.

Finally, such thickness reductions, applied to selective peripheral regions of the cylinder liner where such thickness is unnecessary, include additional benefits of reduced weight. Indeed, the weight benefits apply not only to the cylinder liner, but also to engines that incorporate the improved liner due to commensurately reduced engine lengths.

DETAILED DESCRIPTION OF THE EMBODIMENTS

Figure 1:
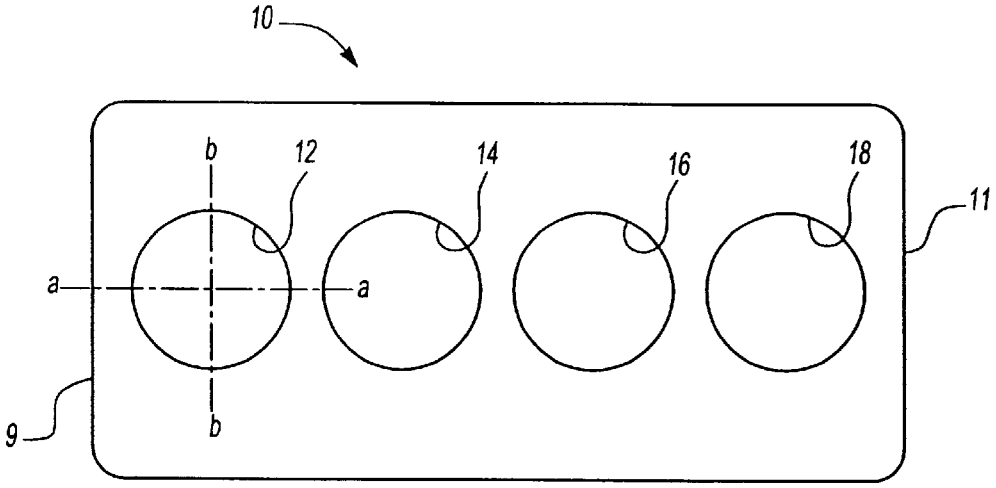
FIG. 1 is a plan view of an engine block of an internal combustion engine that incorporates the improved cylinder liner of the present invention.

Referring initially to FIG. 1, an engine block 10 of an internal combustion engine (not shown) includes a plurality of cylinder bores 12, 14, 16, 18. Referring particularly to cylinder bore 12, which will be used as a primary reference herein, an axis a—a defines both a piston pin axis and a vertically extending piston pin plane, as will be further described herein. A separate axis b—b defines a piston thrust axis and a vertically extending piston thrust plane, as will also be further described herein. It will be appreciated that the respective axes, as well as the respective planes, are orthogonal with respect to one another.

Figure 2:
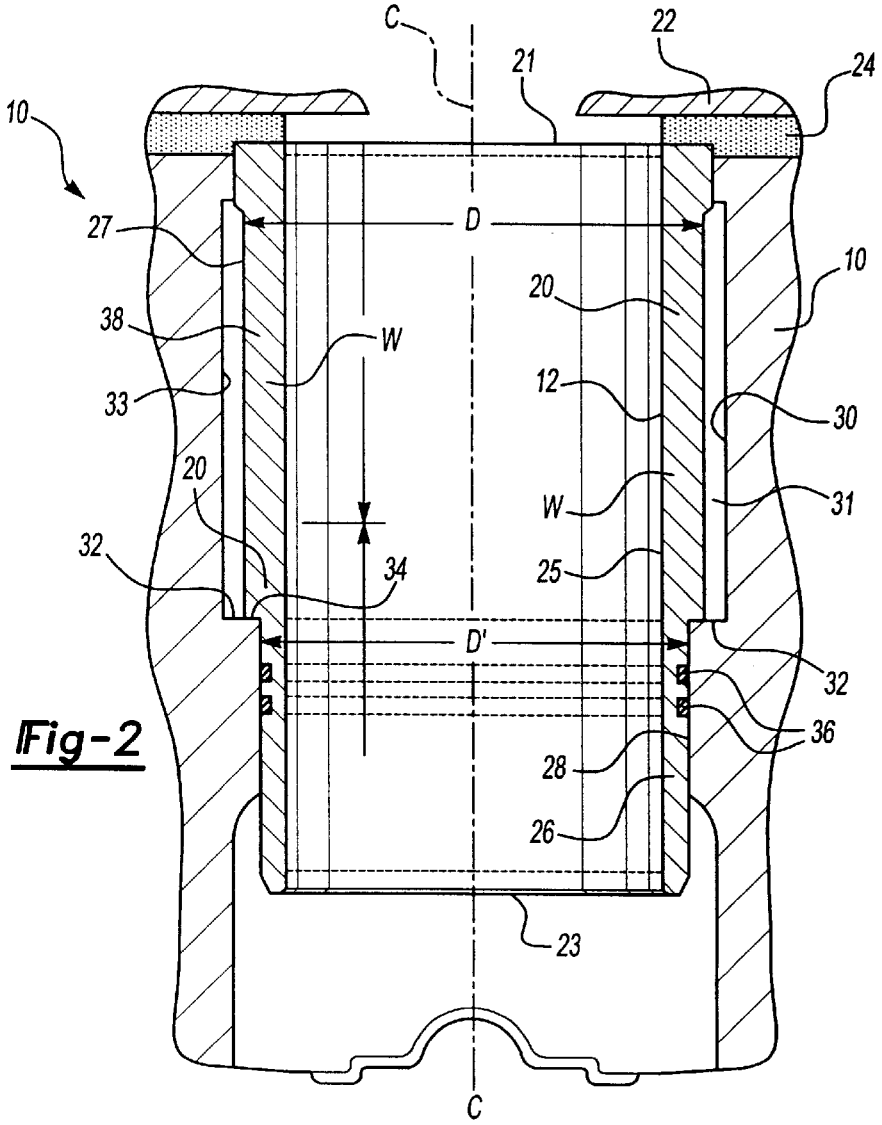
FIG. 2 is an enlarged cross-sectional view of one embodiment of a liner incorporated in the engine block of FIG. 1
Figure 3:
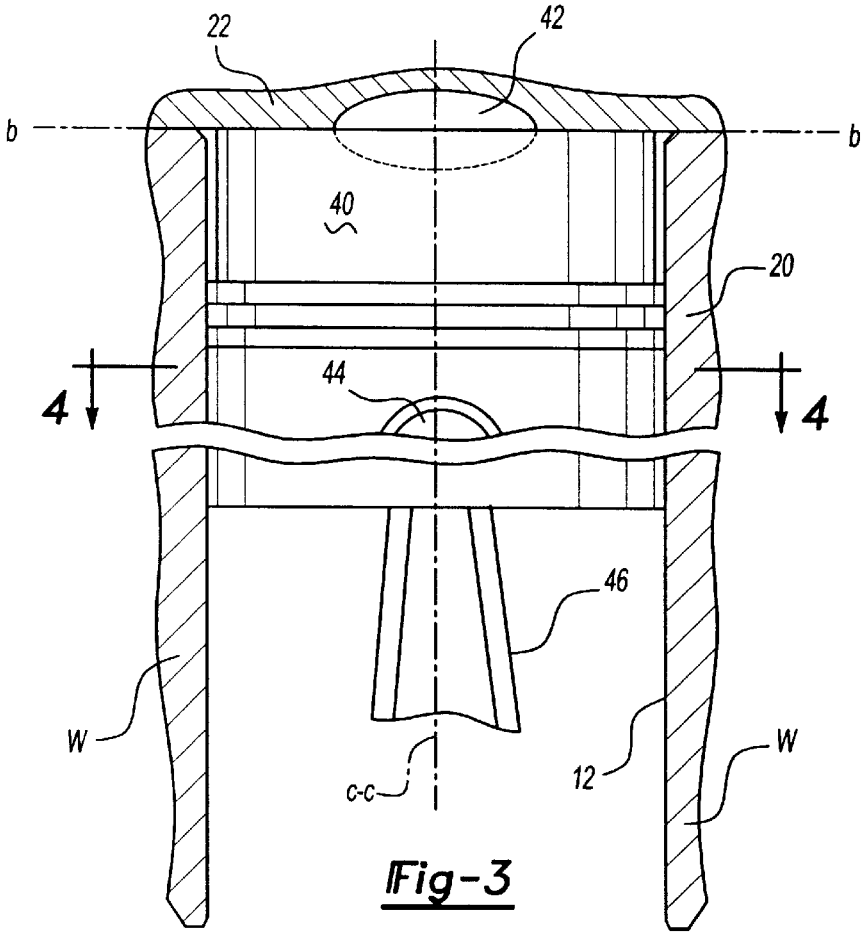
FIG. 3 is fragmentary cross-sectional view of the liner of FIG. 2, shown to include a reciprocally movable piston.

Referring now to FIGS. 2 and 3, an improved cylinder liner 20 of the present invention is defined by a tubular body (20) having a cylindrical bore 12 (as representatively identified in FIG. 1) defining an interior surface 25. The surface 25 is adapted for encasing a closely received piston 40 for reciprocal movement therein along an axis c—c of the bore 12. The liner 20 is physically supported on a circumferential shoulder 32 of a liner-receiving bore 30 of the engine block 10. For this purpose, the liner 20 has shoulder 34 on an exterior surface 27 thereof adapted to supportably engage the shoulder 32. The liner incorporates a lower body pilot portion 26 adapted to be closely received within a reduced diameter portion 28 of the bore 30.

An upper body portion 38 of the liner 20 is circumferentially spaced from an upper circumferential interior surface 33 of the bore 30 to define an annular water jacket 31, as will be appreciated by those skilled in the art. Such jackets provide conventional media for carrying away combustion heat from the cylinder bore 12. The combustion heat has its origins in a combustion chamber 42, positioned atop the piston 40, as shown in FIG. 3.

A pair of grooves 36 is situated in the pilot portion 26 of the liner 20. The grooves 36 accommodate O-ring seals to avoid leakage of coolants and/or crankcase gases. A cylinder head gasket 24 juxtaposed between the liner 20 and a conventional cylinder head 22 bears against and seals the top 21 of the liner 20.

Referring now particularly to FIG. 3, the piston 40, shown fragmentarily, is encased within the liner 20 as earlier noted. The piston is connected by a piston pin 44 to a crankshaft (not shown) by means of a connecting rod 46. Those skilled in the art will appreciate that the piston 40 will not only move up and down along the depicted axis c—c, but will also tend to move side-to-side along the axis b—b via forces imposed on the piston by the aforedescribed side-to-side movement of the crankshaft 46. Thus, the present inventors have realized that although the design thickness of walls of the liner 20 along the b—b axis (FIGS. 1 and 3) are not be compromised (due particularly to the piston side thrust loads), an opportunity is presented for reducing the thickness of the walls W in regions of the liner 20 where such thickness is unnecessary. Thus, for example, the thickness of opposed walls W that are oriented along the axis a—a (FIG. 1) of the piston pin 44 (FIG. 4) are such regions where piston side-to-side thrust forces have no significant impact.

Figure 4:
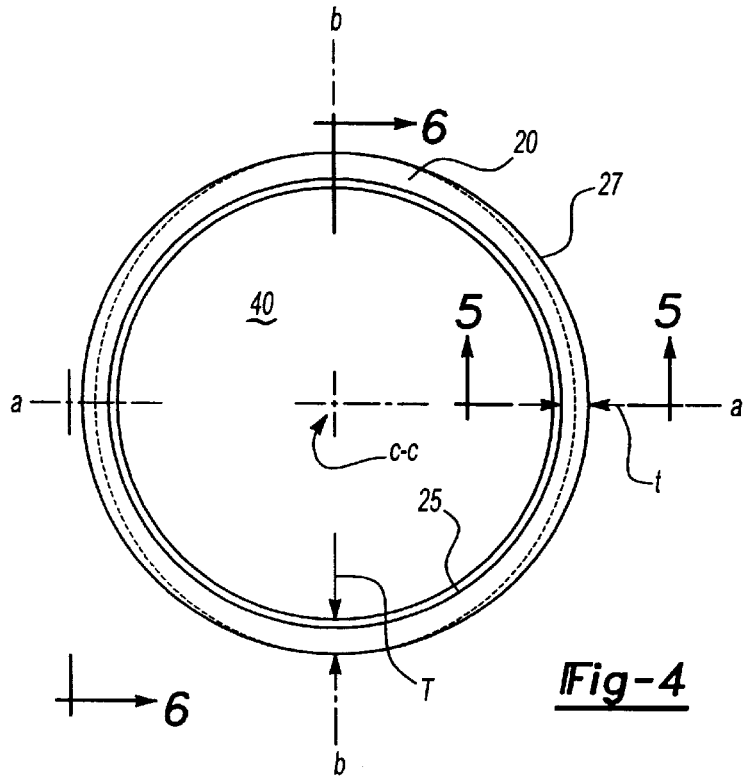
FIG. 4 is a sectional view of the piston and liner assembly of FIG. 3, shown along lines 4—4 of FIG. 3.
Figure 5:
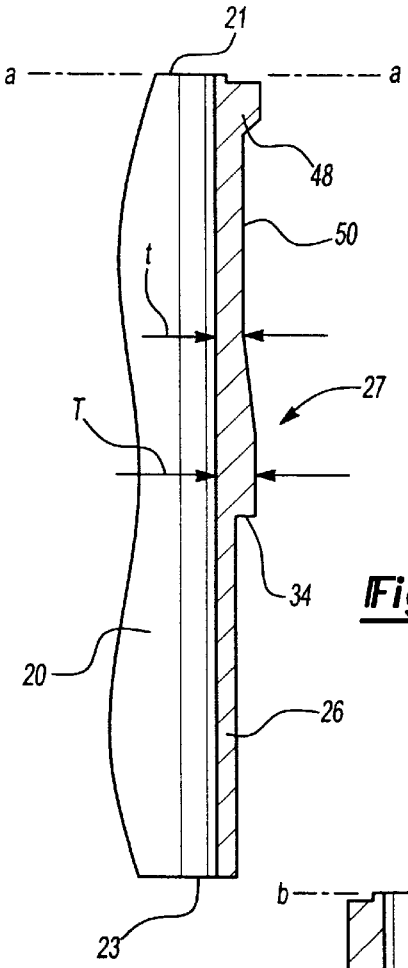
FIG. 5 is a fragmentary sectional view of the liner taken along the plane of the piston pin axis, as shown along lines 5—5 of FIG. 4.
Figure 6:
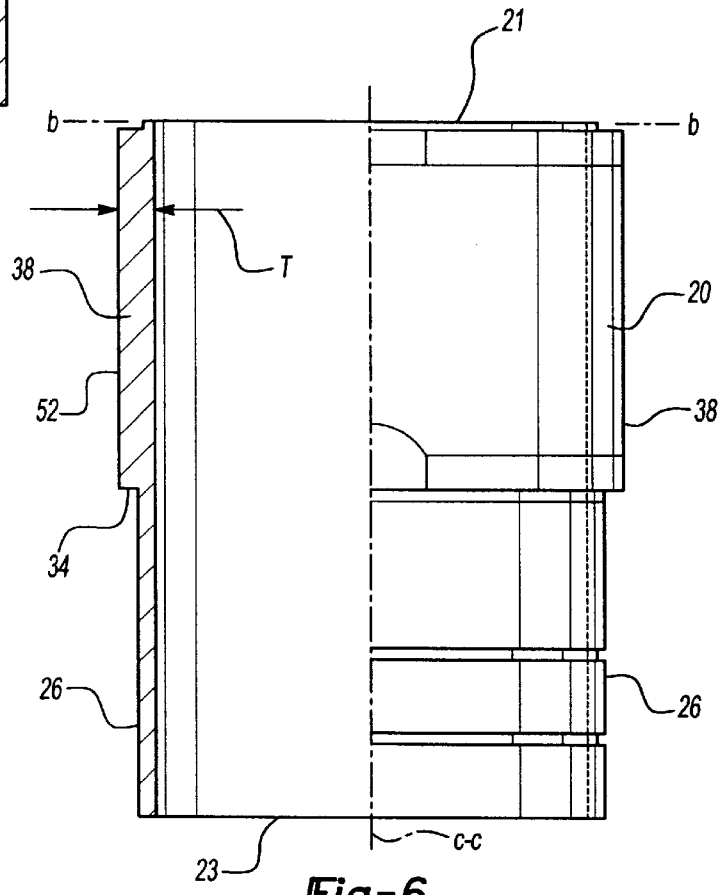
FIG. 6 is a partial cross-sectional view depicting the liner of the same embodiment, shown along lines 6—6 of FIG. 4.

Referring particularly now to FIGS. 4, 5, and 6, specific features of selectively reduced wall thickness of the cylinder liner 20 may be further described. Thus, referring initially to FIG. 4, it will first be appreciated that the reduced wall thickness of this invention will affect only the external dimensions of the tubular shaped liner 20, and that the interior surface 25 of the liner 20 will remain fully cylindrical. As such, the interior surface 25 will have a uniform, hence constant, radius of curvature at any given cross-section normal to the longitudinal axis c—c of the cylinder liner.

As earlier noted, the piston side-to-side thrust plane lies along axis b—b. To the extent that the wall thickness T of the liner in the region of the b—b axis will not be reduced, the axis b—b comprises a major axis with respect to the circumferential exterior surface 27 of the liner 20. On the other hand, the thickness t of the liner along the a—a (piston pin) axis is less than the thickness T without compromising integrity of the liner for meeting performance requirements.

Referring now specifically to FIG. 5, a side view of the reduced wall thickness portion is identified at region 50, wherein a reduction comparison between thicknesses t and T can be more fully appreciated. In the embodiment disclosed, the reduction of wall thickness is such that the thickness t is in a range of approximately 45–60 percent of the thickness T.

It will further be appreciated that the reduced thickness t of the exterior 27 of the liner 20 results in the need for an upper shoulder portion 48 to provide a fully circular exterior circumference 27 at the top 21 of the liner 20. The shoulder 48 is provided to adequately pilot the liner within the engine bore 30. Theoretically, the reduced thickness portion t, hence the region 50, could run the entire length of the liner from top 21 to bottom 23 if appropriate alternative accommodations for the pilot portion 26, shoulder support 34, and upper shoulder portion 48 for the liner 20 are provided.

Finally, referring to FIG. 6, a side view along the major axis b—b reveals that the unreduced thickness T is reflected in the thrust plane region 52. Obviously, the views of FIG. 5 and FIG. 6 are taken 90 degrees apart from one another about the circumference of the liner 20.

In conclusion, the described invention provides a cylinder liner 20 wherein a conventional wall thickness T is maintained in a piston thrust plane region 52 of the liner, wherein side-to-side motions of the piston 40 tend to produce deflections of both the liner 20 and of the head gasket 24 that bears against the liner. Moreover, to the extent that the reduced wall thickness t in a region intersected by the axis a—a produces a shorter dimension along that axis, the exterior surface 27 of the liner 20 will be mildly elliptical, having a minor axis aligned with the plane of the piston pin 44. Obviously the major axis b—b will be aligned to accommodate the piston side-to-side thrust forces; hence the major axis will lie in the piston thrust plane.

Those skilled in the art will appreciate that a plurality of such liners having reduced exterior dimensions along the a—a axis will permit an engine designer to reduce overall length of an engine due to shortened bore spacing requirements along the plane passing through the piston pin axis a—a of each of the collective cylinder bores 12, 14, 16, 18 (FIG. 1). As a result, the extremities 9 and 11 of the engine block 10 will be able to span a shorter distance than an engine block with conventional cylinder liners. In addition, the cylinder liner 20, having a shorter axis a—a, will accommodate enlargement of the space between the plurality of liners 20 defining the bores 12, 14, 16, 18, to permit larger coolants passages, and hence coolants flows, between individual liners 20.

It is to be understood that the above description is intended to be illustrative and not limiting. Many embodiments will be apparent to those skilled in the art upon reading the above description. The scope of the invention should be determined, however, not with reference to the above description, but with reference to the appended claims with full scope of equivalents to which such claims are entitled.

What is claimed is:

1. A cylinder liner for an internal combustion engine, the cylinder liner comprising:

a tubular body having a longitudinal axis and defining interior and exterior surfaces, the interior surface having a substantially cylindrical shape along the longitudinal axis of the cylinder liner, and the exterior surface having a non-constant radius of curvature at a given cross-section normal to the longitudinal axis of the cylinder liner, wherein said cylinder liner comprises a reduced wall thickness in a piston pin plane of the liner.

2. The cylinder liner of claim 1 wherein a conventional wall thickness of the cylinder liner is maintained in a piston thrust plane region of said cylinder liner, wherein side-to-side motions of a piston reciprocating within the liner tend to produce deflections of the liner, and of a head gasket that bears against the liner.

3. The cylinder liner of claim 2 wherein said piston pin plane of said cylinder liner is orthogonal to the piston thrust plane.

4. The cylinder liner of claim 1 wherein said reduced wall thickness comprises a reduction in only external dimensions of the liner, and wherein the interior bore of the liner remains fully cylindrical.

5. The cylinder liner of claim 1 wherein said exterior surface of said cylindrical liner is elliptical, having a minor axis aligned with the plane of the piston pin.

6. The cylinder liner of claim 1 further comprising a plurality of said liners, and wherein said reduced exterior dimension of said liners permits reduction of engine length due to shortened bore spacing requirements along the piston pin plane.

7. The cylinder liner claim 1 further comprising a plurality of said liners, and wherein said reduced exterior dimension in said piston pin plane of said liner permits enlargement of space between said plurality of liners for enhanced coolant flow between the individual liners.

8. A cylinder liner for an internal combustion engine, the cylinder liner comprising:

a tubular body having a longitudinal axis and defining interior and exterior surfaces, the interior surface having a substantially cylindrical shape along the longitudinal axis of the cylinder liner, and the exterior surface having a non-constant radius of curvature at a given cross-section normal to the longitudinal axis of the cylinder liner, wherein said cylinder liner comprises a reduced wall thickness in a piston pin plane of the liner, wherein said reduced wall thickness comprises a reduction in only external dimensions of the liner, and said exterior surface of said cylindrical liner is elliptical, having a minor axis aligned with the plane of the piston pin.

* * * * *